United States Patent [19]

Sikli

[11] 3,983,960

[45] Oct. 5, 1976

[54] SCISSORS LIFT

[75] Inventor: Bert J. Sikli, Venice, Calif.

[73] Assignee: Robert Staines, Paramount, Calif.

[22] Filed: Jan. 20, 1975

[21] Appl. No.: 542,508

Related U.S. Application Data

[63] Continuation-in-part of Ser. No. 406,260, Oct. 15, 1973, abandoned.

[52] U.S. Cl. ..... 187/18; 182/141; 254/122

[51] Int. Cl.[2] ..... B66B 11/04; E04G 1/22

[58] Field of Search ..... 187/1, 18, 8.71, 8.72; 254/122; 74/521; 52/109; 182/63, 141, 148, 69; 108/145; 248/421; D12/54, 56, 57

[56] References Cited

UNITED STATES PATENTS

| | | | |
|---|---|---|---|
| 2,402,579 | 6/1946 | Ross | 187/18 X |
| 3,003,746 | 10/1961 | Gridley | 187/18 X |
| 3,032,319 | 5/1962 | Dale | 254/22 |
| 3,259,369 | 7/1966 | Gridley | 187/18 X |
| 3,446,379 | 5/1969 | Phillips | 254/122 X |
| 3,486,583 | 12/1969 | Wiklund | 187/18 |
| 3,796,282 | 3/1974 | Denier | 254/122 X |

FOREIGN PATENTS OR APPLICATIONS

| | | | |
|---|---|---|---|
| 879,098 | 10/1961 | United Kingdom | 254/122 |

OTHER PUBLICATIONS

Ballymore Co. Advertisement, *Modern Materials Handling*, vol. 26, No. 1, Jan., 1971, p. 91.

Ballymore Co. Sales Bulletin S-70R, West Chester, Pennsylvania. hydraulic

*Primary Examiner*—Evon C. Blunk
*Assistant Examiner*—James L. Rowland
*Attorney, Agent, or Firm*—Romney Schaap Golant Scillieri & Ashen

[57] ABSTRACT

An improved scissors lift is provided which includes a working platform, two scissors linkages, a frame, and an hydraulic mechanism, all of which combine to permit the working platform to be elevated in a horizontal plane to any desired height, and to permit the lift to be collapsed to a compact position when not in use. The hydralic mechanism, in the form of one or more hydraulic cylinder/piston units, is mounted on the scissors linkages in an essentially vertical position in appropriate cradles between two of the arm pairs of the linkages, at a position in which there is substantial movement at both ends of the hydraulic unit. The cylinder/piston hydraulic unit is so mounted to exert a thrust primarily in the direction of the load for all positions of the linkages, and to provide an essentially constant load/thrust/speed ratio for all positions of the linkages, and also to permit full extension of the linkages without excessive movement of the hydraulic piston.

23 Claims, 8 Drawing Figures

FIG. 6.
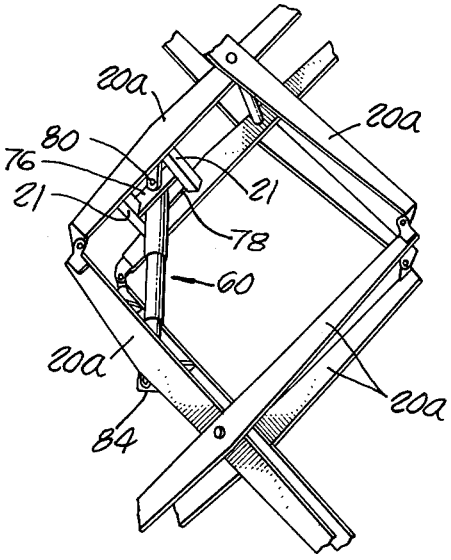
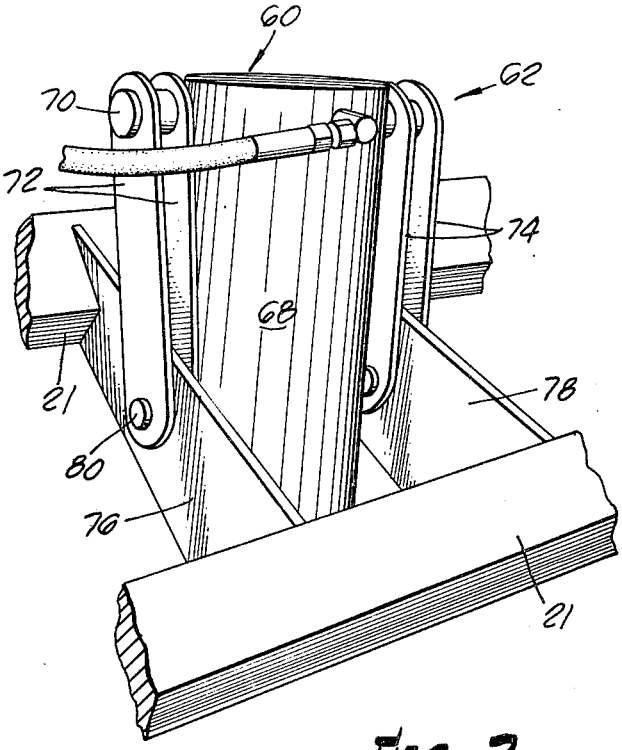
FIG. 7.
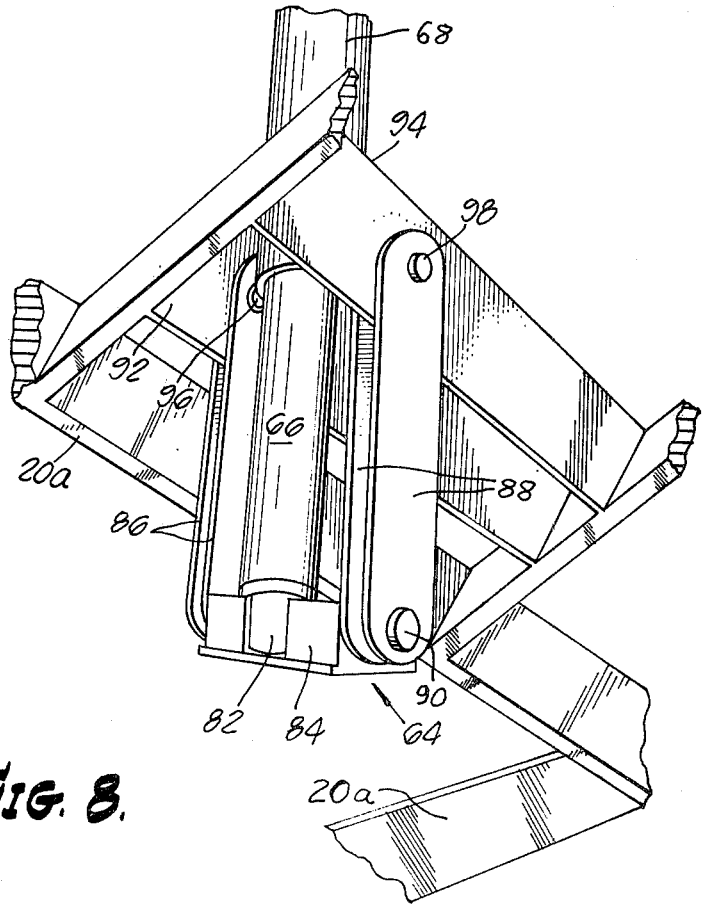
FIG. 8.

SCISSORS LIFT

This application is a continuation-in-part of Co-Pending application Ser. No. 406,260, filed Oct. 15, 1973 and now abandoned.

BACKGROUND OF THE INVENTION

Scissors lift mechanisms in general are known to the art. The principal purpose of such mechanisms is to provide a safe and efficient means for supporting a working platform at any desired elevation. The scissors lift mechanisms of the prior art are predicated on the well-known "lazy tong" principle, and each comprises a pair of vertically extensible scissors linkages mounted on a frame in laterally spaced, parallel relationship, and a working platform mounted on top of the linkages.

Each of the scissors linkages of the prior art lift mechanisms comprise pairs of arms pivotally connected to one another at their ends and at their centers. The lowermost pairs of arms of the linkages are pivotally mounted at one end to the frame, and they are slidably mounted on the frame at their other end. It is usual in the prior art scissors lift mechanisms to provide an hydraulic drive cylinder mechanism which is pivotally mounted to the frame, and which is coupled to a cross-bar extending between the lowermost pairs of arms of the linkages. The hydraulic lift mechanism serves to turn the arms of the lowermost pair about their pivotal axis to extend or retract the linkages and thereby to raise or lower the platform.

A disadvantage in the prior art hydraulic drive is the fact that as the lift mechanism is initially elevated from its lowermost position, the hydraulic cylinder/piston unit of the prior art hydraulic mechanism is positioned almost horizontal, and it must exert an excessively high trust on the mechanism to turn the lowermost arms and to start the vertical extension of the linkages.

Then, as the prior art lift is extended more and more in a vertical direction, the hydraulic lift unit pivots to an upright position, and it requires less and less thrust to move the load. This results in the need for an excessively large hydraulic lift unit in the prior art scissors lift in order to be effective to move the linkages from their retracted to their fully extended position, and it often leads to the requirement for auxiliary hydraulic lift mechanisms, as described above.

The improved construction of the present invention includes an hydraulic cylinder/lift unit which is mounted in an essentially fixed angular position such that the load vector is essentially aligned with the vertical axis of the unit, so that the thrust exerted by the unit is essentially in the direction of the load. Moreover, the hydraulic cylinder/lift unit in the mechanism of the invention is mounted such that the thrust exerted by it remains essentially invariable to move the load through all positions of the linkages. This results in minimizing the required capacity of the hydraulic lift unit without in any way detracting from the efficiency and safety of the unit, and it results in a more economical lift which is capable of movement from a fully compact position to a fully extended position in a simple, economical and efficient manner by means of an hydraulic unit having a fraction of the capacity required in the prior art scissors lift. Saddle mechanisms pivotally secure the upper and lower ends of the hydraulic lift unit in such manner that these units remain in essentially vertical positions.

Specifically, the invention provides a lift in which the hydraulic mechanism is capable of performing a desired function with less thrust and lower capacity requirements than the prior art mechanism, and on a more economical and safer basis.

BRIEF DESCRIPTION OF THE DRAWINGS

FIG. 6 is a perspective representation of a portion of a scissors lift of the type shown in FIG. 1, and which incorporates upper and lower saddle structures for coupling the hydraulic lift unit to the adjacent arms of the scissors lift;

FIG. 7 is another view of the upper saddle structure; and

FIG. 8 is another view of the lower saddle structure.

DETAILED DESCRIPTION OF THE ILLUSTRATED EMBODIMENT

Figure 1:
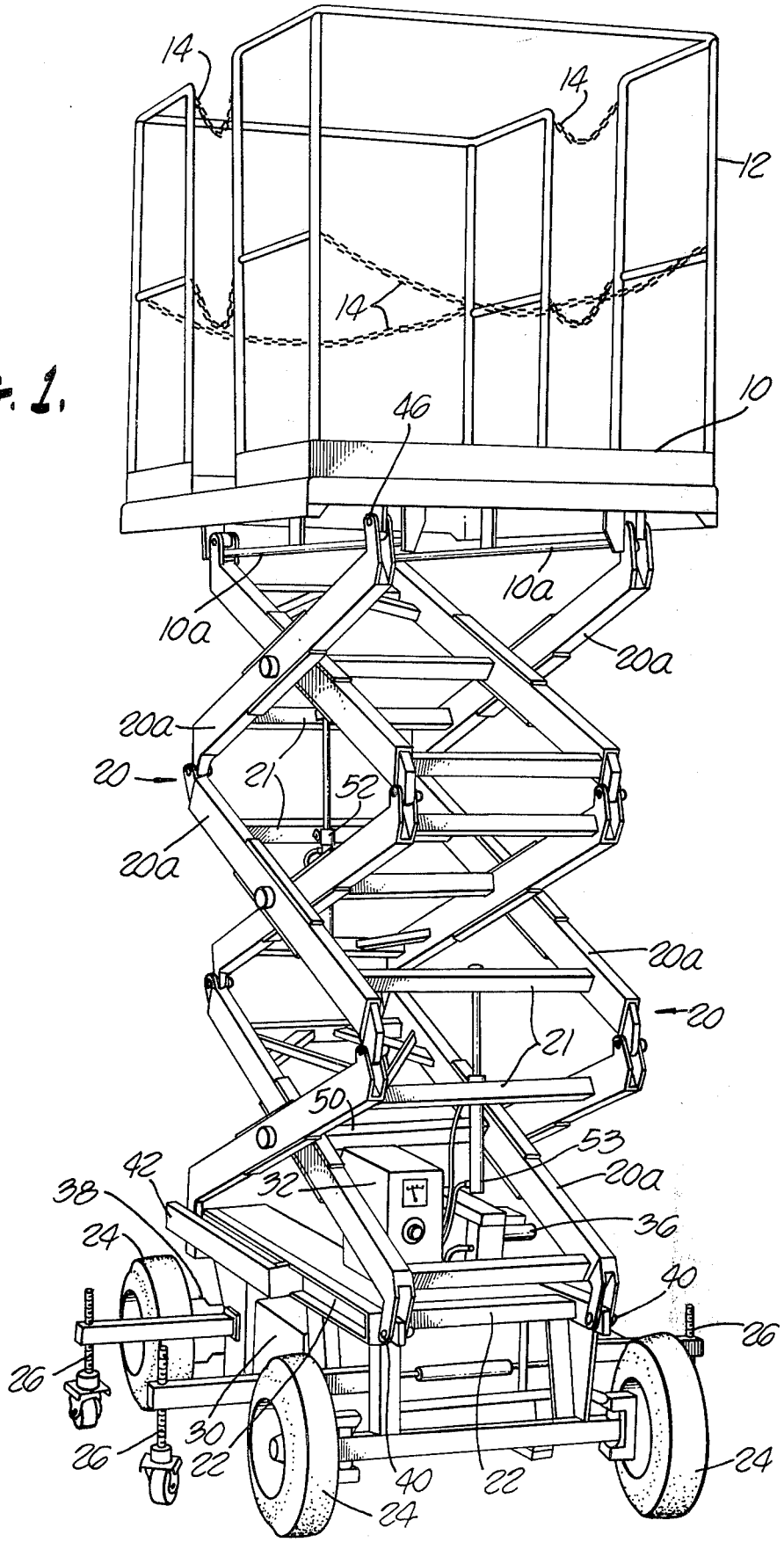
FIG. 1 is a perspective representation of a scissors lift which is driven by two hydraulic cylinder lift units, and which is constructed to embody the concepts and principles of the present invention.

The lift mechanism shown in FIG. 1 includes a usual working platform 10 surrounded by a guard rail 12 equipped with a safety chain 14. The platform 10 is supported at the upper end of a pair of scissors linkages 20. The scissors linkages are mounted on a wheeled frame 22 which is supported on wheels 24, and which is provided with adjustable outriggers 26. Appropriate heavy duty batteries 30 are supported on the frame, as well as a battery charger 32. Also supported on the frame are a plurality of usual solenoid valves, and a drive motor 38.

The scissors linkages are made up of a plurality of arms designated **20*a* which are pivotally coupled to one another at their ends and at their centers, as shown in FIG. 1. The lowermost pairs of arms 20*a* are pivoted at one end to the frame 22 by means, for example, of bolts 40, and the lowermost pairs of arms are slideable at the other end of the frame in slots, such as the slot 42. The uppermost pairs of arms 20*a* are pivoted at one end to the underside of the platform 10 by bolts, such as the bolts 46, and the uppermost pairs of arms are slideable at the other end of the platform along bars, such as the bars designated 10*a*.**

Each of the arms **20*a*** of the scissors linkages is provided with a pair of ear-like brackets at each end. The ear-like brackets may be welded, or otherwise affixed to the ends of the corresponding arms. The ear-like brackets are shaped to displace the pivotal axis at each end of each pair of arms away from the longitudinal axis of the corresponding arms. This assembly permits each pair of arms to fold down directly on top of the arms of the next lower pair when the lift is in its retracted position, so that a minimum height may be achieved when the lift is collapsed, and also to relieve the stresses at the pivotal points.

The scissors linkages are extended to their uppermost position, such as shown in FIG. 1, and retracted to their lowermost position, by means of hydraulic ram means in the form of one or more hydraulic cylinder units mounted on the linkages in a manner to be explained. In the embodiment of FIG. 1, for example, two such hydraulic cylinder/piston lift mechanisms designated 51 and 52 are used. Each of the hydraulic cylinder units in the embodiment of FIG. 1 are mounted on the linkage between corresponding crossbars extending from one linkage to the other and connected to the adjacent pivoted arms of selected pairs in the linkages. These cross-bars are designated 21 in the drawings.

The hydraulic cylinder units in the embodiment of FIG. 1 are vertically mounted in a position for substantial movement at each end of each such unit; and each unit exerts thrusts on the corresponding arms of the linkages at points relatively close to their pivotal points, so that maximum extension of the linkages may be achieved without excessive extension of the pistons of the hydraulic unit.

Figure 2:
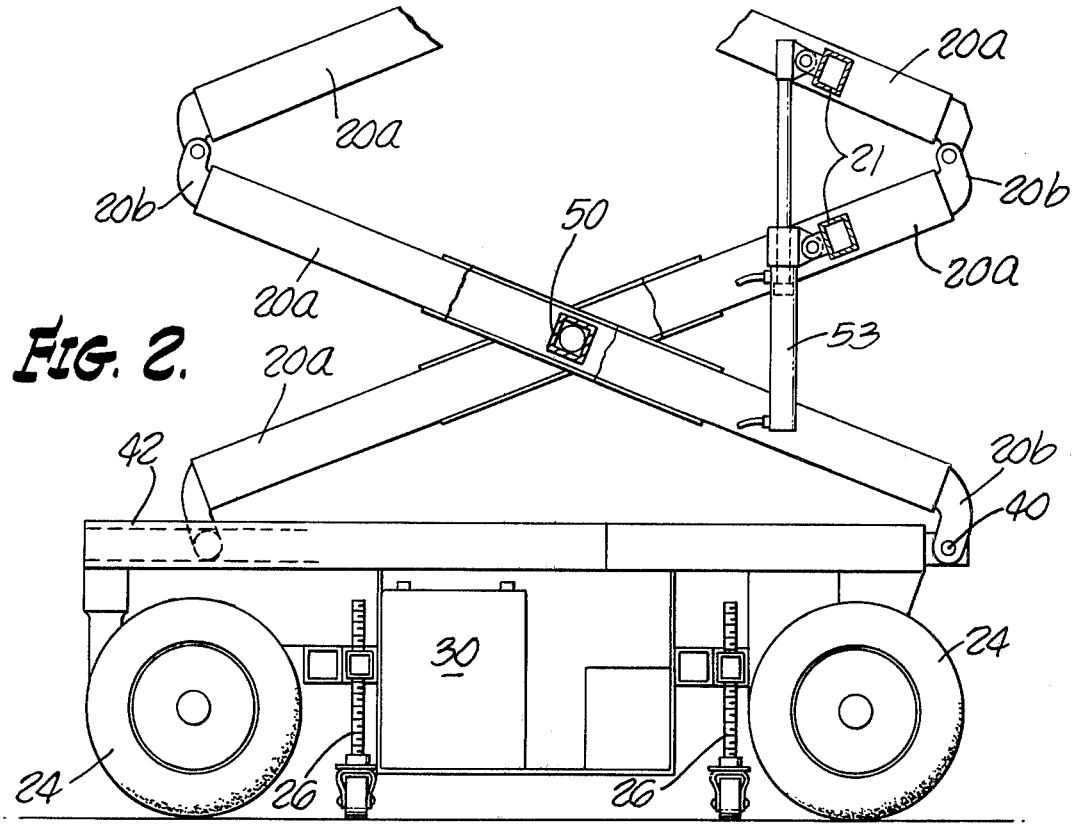
FIG. 2 is a partial side elevation of a lift similar to the lift shown in FIG. 1.

In the embodiment of FIG. 2, a single hydraulic cylinder unit is illustrated, and is coupled to cross-bars extending between adjacent arms of the linkages, as in the previous embodiment. In FIG. 2, the hydraulic cylinder unit 53 extends at an angle slightly to the vertical.

Figure 3:
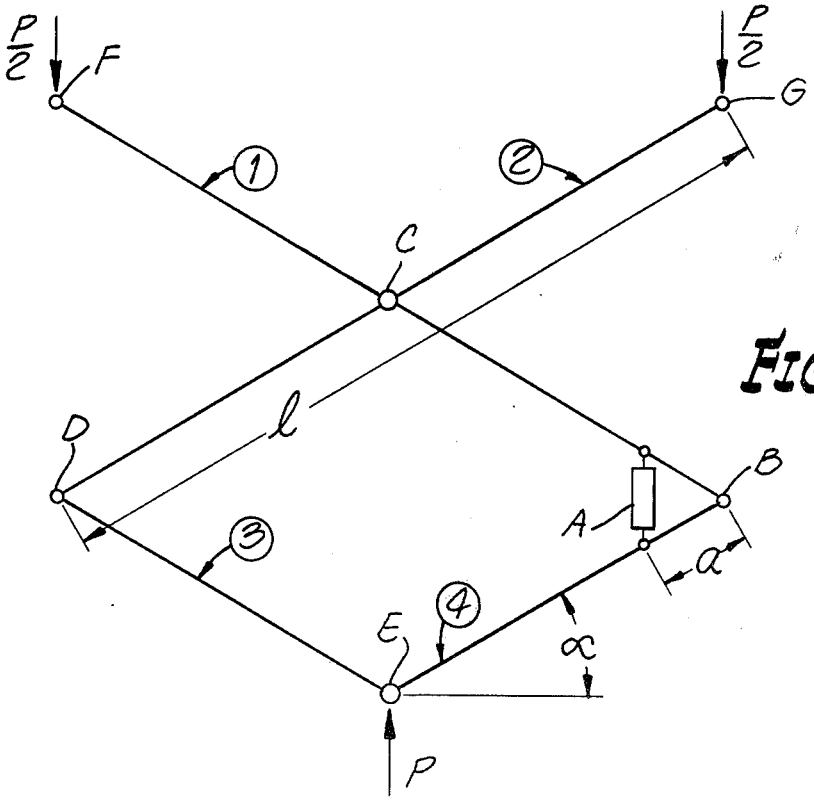
FIG. 3 is a schematic force diagram of the thrust exerted on the arms of the scissors lift by each of the hydraulic units in the mechanism of FIG. 2.

In the force diagram of FIG. 3 the arms of one of the linkages are designated 1, 2, 3 and 4 respectively, and the hydraulic cylinder unit A is shown as intercoupled between the arms 1 and 4 adjacent the pivot point B of the two arms. The arms 1 and 2 are pivoted at a point C at the center of the arms, the arms 2 and 3 are pivoted at a point D at the ends of the arms, and the arms 3 and 4 are pivoted at a point E at the ends of the arms.

The upper platform asserts a downward force P/2 at the ends F and G respectively of the arms 1 and 2, whereas the hydraulic cylinder unit effectively exerts a force P at the intercoupled end E of the arms 3 and 4. Each of the arms is assumed to have a length of 1, the hydraulic cylinder unit A is assumed to be displaced from the pivot point B by a distance a. The inclination of the arms to the horizontal in the illustrated diagram of FIG. 3 is $\alpha$.

Figure 4:
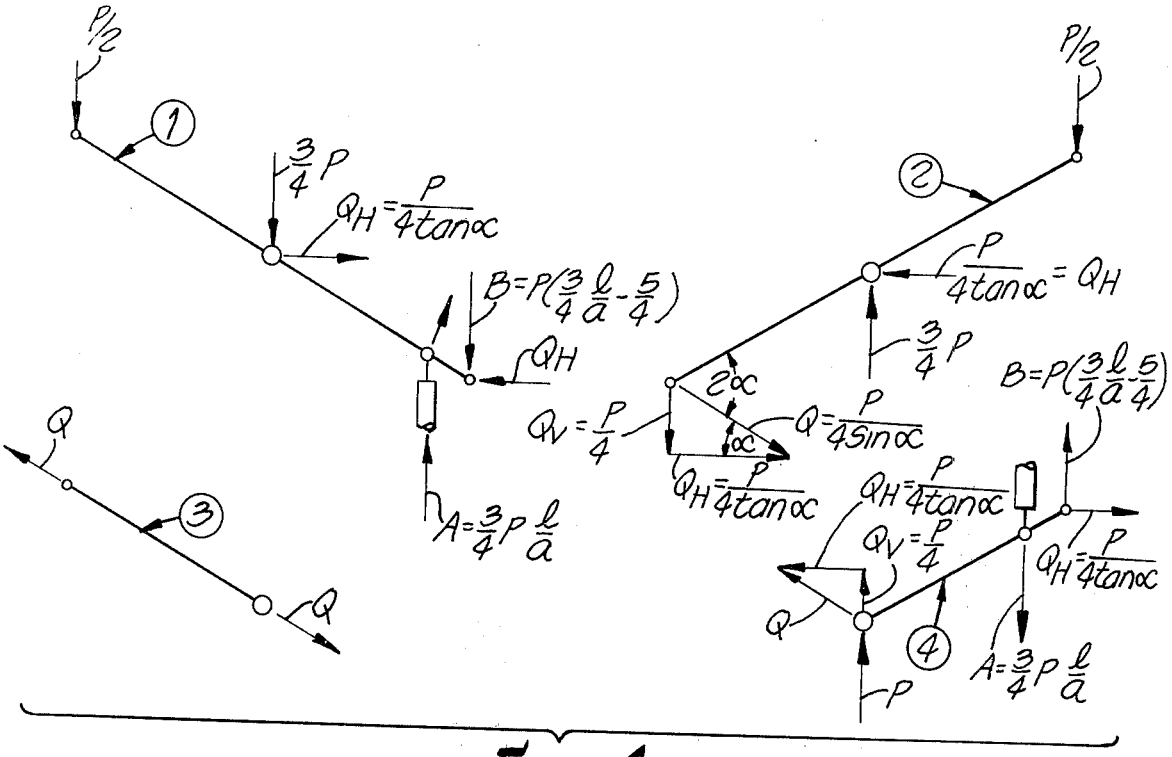
FIG. 4 are vector diagrams of the forces developed in the force diagram of FIG. 3.

The resulting bending moment forces exerted on the arms 1, 2 and 4 are represented in FIG. 4, the arm 3 being purely in tension. The resulting bending moments on the arms are represented by the curves of FIG. 5.

Figure 5:
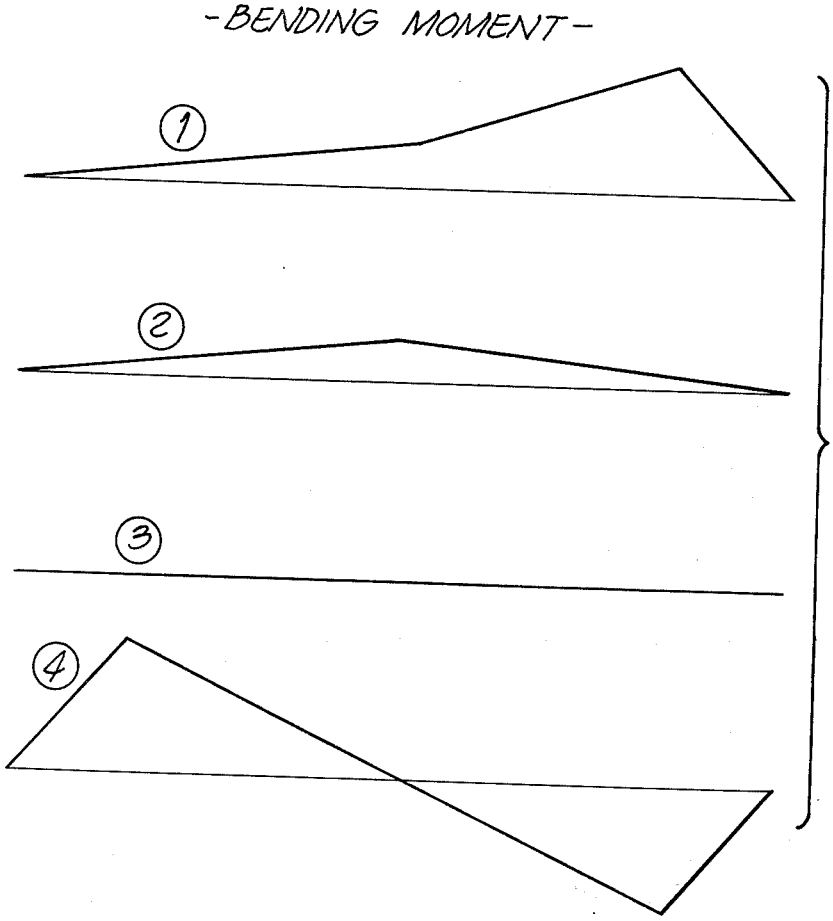
FIG. 5 is a series of curves showing the bending moments on the various arms of the scissors lift shown in the force diagram of FIG. 3.

It will be appreciated from a consideration of the diagrams and equations of FIGS. 3–5 that the structure illustrated in FIG. 1 and the structure illustrated in FIG. 2 are capable of being controlled by the hydraulic cylinder units illustrated in FIGS. 1 and 2 and coupled in the illustrated manner to the linkages.

In the mechanism shown in FIGS. 1 and 2, and described above, the hydraulic units extend essentially in the direction of load, and exert an essentially uniform thrust for all positions of the linkages. This means, as explained above, that the capacity requirements of the hydraulic cylinder units may be minimized, since unlike the prior art mechanisms, there are no excessive load requirements placed on the hydraulic units when the lift mechanism is first elevated from its collapsed position. Also, the positioning of the hydraulic cylinder units adjacent the pivot points of the corresponding arms of the scissors linkages permits the unit to move the scissors lift from its fully retracted to its fully extended position without excessive displacement of the piston in the hydraulic cylinder unit.

The representations of FIGS. 6, 7 and 8 show upper and lower saddle structures for coupling the hydraulic cylinder unit to the adjacent arms 20*a* of the scissors lift mechanism, so as to permit the hydraulic unit to remain in an essentially vertical position as it drives the arms 20*a* coupled to the upper and lower ends of the hydraulic unit angularly about the axis of their hinges.

In the embodiment of FIGS. 6–8, the hydraulic unit 60 is suspended between the cross bars 21 of the respective arms 20*a* by means of upper and lower saddle structures 62 and 64, respectively. In the illustrated embodiment, the hydraulic unit 60 has two telescoping pistons 66 and a cylinder 68, with the unit 60 being mounted so that the cylinder 68 is at the upper end of the unit, pivotally secured to the upper saddle structure 62. Thus, the pistons 66 extend downwardly and are pivotally secured to the saddle structure 64. As shown, the upper end of the cylinder 68 of the hydraulic unit 60 has a transverse pin 70 extending through it which pivotally mounts the upper ends of two pairs of linkages 72 and 74 on either side of the cylinder 68. The other ends of the linkages 72 and 74 are pivotally coupled to respective brackets 76 and 78 which extend between the adjacent cross bars 21, this being achieved by means of pins, such as the pin 80. These elements constitute the upper saddle structure 62.

By further reference to FIG. 7, it can be observed that each linkage in a pair of such linkages is similarly sized to and retained in spaced apart parallel relation to the other linkage of such pair. Moreover, it can also be observed that the brackets 76 and 78 are generally perpendicular to the cross bars 21 and generally parallel in space to the respective arms 20a with which they are associated.

The lower end of the piston 66 of the hydraulic unit 60 is secured to the saddle structure 64 in the manner as illustrated in FIG. 8. The lower end of the piston 66 is provided with an extended flange 82. The lower saddle structure 64 has a transverse member 84 attached to the flange 82, and this transverse member 84 is pivotally coupled to the lower ends of adjacent pairs of linkages 86 and 88 by means of a pin 90. It should be understood that the flange 82 and the transverse member 84 are provided with aligned apertures (not shown) which accommodate the pin 90, and in this way the piston 66 is attached to the transverse member 84. The upper ends of the linkages 86 and 88 are respectively coupled to brackets 92 and 94 by pins 96 and 98, respectively. These latter elements constitute the lower saddle structure 64.

By further reference to FIG. 8, it can also be observed that each linkage in a pair of the linkages 86 and 88 is similarly sized to and retained in spaced apart parallel relation to the other linkage of such pair. In like manner, the brackets 92 and 94 are generally perpendicular to the cross bars 21 and are generally parallel in space to the arms 20*a*. The linkage arms 20*a* are also illustrated in FIG. 8 in order to show the perpendicular relationship between the cross bars 21 and the parallel relationship to the arms 20*a*.

The upper and lower saddle structures described above serve to maintain the hydraulic cylinder unit 60 in an essentially vertical position, as it moves the upper and lower adjacent arms 20a angularly to raise and lower the scissors lift mechanism. These saddle structures permit the lift to be completely retracted so that the adjacent arms 20*a* lie across one another when the platform is in its lowermost position, and then to be fully extended, with the hydraulic unit 60 being maintained in its vertical position at all times, so as to exert maximum force on the adjacent arms.

The resulting mechanism constructed in accordance with the invention is relatively simple and economical in its construction, and yet it is capable of performing all the functions of the equivalent complex prior art mechanisms at all load levels, and on a simpler, more economical and safer basis.

Having described the invention as related to particular embodiments, there is no intention that the invention should be limited by any of the details of the description, unless otherwise specified. Rather, the invention is intended to be construed within its spirit and scope as set forth in the accompanying claims.

What is claimed is:

1. A load lifting scissors lift assembly comprising: a lower frame; an upper platform; a plurality of cross lever arms forming a pair of laterally-spaced vertically-extensible parallel scissors-type linkages interposed between said lower frame and said upper platform, the lever arms of each of said linkages being pivotally coupled to one another at the ends thereof and at a point intermediate said ends; an essentially vertically positioned extensible drive unit; at least one first transverse cross-bar extending between a first pair of arms of said linkages; at least one second transverse cross-bar extending between a second pair of arms of said linkages; first saddle means pivotally connected to an upper end of said drive unit; second saddle means pivotally connected to the lower end of said drive unit; and connecting means connecting the first and second saddle means respectively to said first of said cross-bars and to said second of said cross-bars, said connecting means including first longitudinal means pivotally secured to the first saddle means and operatively connecting one end of said drive unit to said first pair of arms at a point intermediate the ends thereof, and second longitudinal means pivotally secured to the second saddle means and operatively connecting the other end of said drive unit to said second pair of arms at a point intermediate the ends thereof, the first and second transverse cross-bars and the first and second saddle means being located in substantially vertical alignment such that said first and second cross-bars and said first and second saddle means are essentially vertically movable in opposite directions as the lift mechanism raises and lowers the upper platform.

2. The load lifting scissors lift assembly as defined in claim 1, in which said extensible drive unit comprises an hydraulic cylinder unit having a cylinder and a piston, and wherein the cylinder is connected to the first saddle means and the piston is connected to the second saddle means.

3. The load lifting scissors lift assembly defined in claim 1, in which one end of the arms of said first pair of arms is each pivotally coupled to one end of said second arms.

4. The load lifting scissors lift assembly defined in claim 1, in which said first cross-bars are each connected to a point on each said first arm on said first pair of arms between the center and one end thereof, and in which said second cross-bars are each connected to a point on each said second arm on the second pair of arms between the center and one end thereof.

5. The load lifting scissors lift assembly defined in claim 1, in which a first pair of cross-bars are affixed to and extending between a first pair of arms of said linkages and positioned between the centers of said arms of the first pair and the respective ends thereof; and in which a second pair of cross-bars are affixed to and extending between a second pair of said arms of said linkages and positioned between the centers of the arms of the second pair of the respective ends thereof.

6. The load lifting scissors lift assembly defined in claim 5, in which the ends of the arms of the second pair are pivotally coupled to the ends of the arms of the first pair.

7. A load lifting scissors lift assembly comprising: a base frame; an upper platform; first and second pairs of crossed lever arms forming a pair of laterally-spaced, vertically-extensible, parallel scissor-type linkages interposed between said base frame and said upper platform, said lever arms of said linkages being operatively coupled to said base frame and said platform to enable vertical shiftable movement of said platform relative to said base frame; an extensible drive unit; a first pair of transverse members extending between each arm of said first pair of lever arms and a second pair of transverse members extending between each arm of said second pair of lever arms; a first saddle structure pivotally connected to one end of said drive unit and also being operatively pivotally connected to said first pair of transverse members; and a second saddle structure pivotally connected to the other end of said drive unit and also being operatively pivotally connected to the second pair of said transverse members, said first and second saddle structures being located in substantially vertical alignment such that said drive unit is permitted to remain in substantially the same vertical position in space relative to movement of said lever arms during their vertically extensible movement.

8. The load lifting scissors lift assembly defined in claim 7, and in which said extensible drive unit is an essentially vertically positioned extensible drive unit.

9. The load lifting scissors lift assembly defined in claim 7 and in which said extensible drive unit is an essentially vertically positioned extensible hydraulic drive unit.

10. The load lifting scissors lift assembly defined in claim 7 and in which said first pair of spaced apart and parallel cross-bars extend between said first pair of lever arms of said linkages, and a first pair of spaced and parallel longitudinal brackets extend between the cross-bars of said first pair of cross-bars, and the first of said saddle structures is pivotally secured to said first pair of longitudinal brackets.

11. The load lifting scissors lift assembly defined in claim 10 and in which said second pair of spaced apart and parallel cross-bars extend between said second pair of lever arms of said linkages, and a second pair of spaced and parallel longitudinal brackets extend between the cross-bars of said second pair of cross-bars, and the second of said saddle structures is pivotally secured to the second pair of longitudinal brackets.

12. The load lifting scissors lift assembly defined in claim 7, and wherein said first saddle structure comprises a plurality of first linkage arms, each of said linkage arms having one end pivotally coupled to one end of said drive unit and each of said first linkage arms having their other ends pivotally coupled to the longitudinal brackets of the first pair of longitudinal brackets.

13. The load lifting scissors lift assembly defined in claim 12, and wherein said second saddle structure comprises a plurality of second linkage arms, each of said second linkage arms having one end pivotally coupled to another other end of said drive unit, and each of said second linkage arms having their other ends pivotally coupled to the longitudinal brackets of the first pair of longitudinal brackets.

14. A load lifting scissors lift assembly comprising: a lower frame, an upper platform; a plurality of cross lever arms forming a pair of laterally-spaced vertically-extensible parallel scissors-type linkages interposed between said lower frame and said upper platform, the lever arms of each of said linkages being pivotally coupled to one another at the ends thereof and at a single point intermediate said ends; an essentially vertically positioned extensible drive unit; and connecting means for connecting said drive unit to a first of said arms and to a second of said arms, said connecting means including at least one first transverse member directly connected said first arm at a point intermediate the ends thereof, at least one second transverse member directly connected to said second arm at a point intermediate the ends thereof, first saddle means pivotally connected to said first transverse member and pivotally connected to one end of said drive unit, and second saddle means pivotally connected to said second transverse member and to the other end of said drive unit, the first and second saddle means being located in substantially vertical alignment and being arranged so that the first and second transverse members are essentially vertically movable in opposite directions as the lift assembly raises and lowers the upper platform and the drive unit remains in substantially the same vertical position in space relative to the movement of said lever arms during their vertically extensible movement.

15. The load lifting scissors lift assembly defined in claim 14, in which said extensible drive unit comprises an hydraulic piston cylinder unit.

16. The load lifting scissors lift assembly defined in claim 14, in which one end of said first arm is pivotally coupled to one end of said second arm.

17. The load lifting scissors lift assembly defined in claim 14, in which said first transverse member is connected to a point on said first arm between the center and one end thereof, and in which the second transverse member is connected to a point on the second arm between the center and one end thereof.

18. A load lifting scissors lift assembly comprising: a lower frame; an upper platform; a plurality of crossed lever arms forming a pair of laterally-spaced vertically-extensible parallel scissors-type linkages interposed between said lower frame and said upper platform, the lever arms of each of said linkages being pivotally coupled to one another at the ends thereof and at a single point intermediate said ends; an essentially vertically positioned extensible hydraulic piston/cylinder drive unit; and connecting means connecting said piston of said drive unit to a first pair of said arms of said laterally-spaced linkages, said connecting means connecting the cylinder of said drive unit to a second pair of said arms of said laterally-spaced linkages, said connecting means including a first pair of spaced apart first transverse cross-bars extending between said first pair of arms, a first pair of longitudinal segments extending between said first cross-bars, first vertical linkage means for connecting the piston of said drive unit solely to said first pair of cross-bars so that the piston is located at a point intermediate the ends of said first pair of arms, said first transverse cross-bars affixed to and extending between the centers of said arms of the first pair and the respective ends thereof, a second pair of spaced apart transverse cross-bars extending between said second pair of arms, a second pair of longitudinal segments extending between said second pair of cross-bars, second vertical linkage means for connecting the cylinder of said drive unit solely to said second pair of cross-bars so that the cylinder is located at a point intermediate the ends of said second pair of arms, said second transverse cross-bars affixed to and extending between said second pair of arms of said linkages and positioned between the centers of the arms of the second pair of arms and the respective ends thereof, the first and second cross-bars being essentially vertically movable in opposite directions as the lift assembly raises and lowers the upper platform, and means pivotally coupling the ends of the arms of the first pair of arms to the ends of the arms of the second pair of arms.

19. The load lifting scissors lift assembly defined in claim 18, in which said first pair of transverse cross-bars is connected to a point on each arm of said first pair of arms between the center and one end thereof, and in which said second pair of transverse cross-bars is connected to a point on each arm of the second pair of arms between the center and one end thereof.

20. A load lifting scissors lift assembly comprising: a lower frame; an upper platform; a plurality of cross lever arms forming a pair of laterally-spaced vertically-extensible parallel scissors-type linkages interposed between said lower frame and said upper platform, the lever arms of each of said linkages being pivotally coupled to one another at the ends thereof and at a point intermediate said ends; an essentially vertically positioned extensible drive unit; first saddle means pivotally connected to an upper end of said drive unit; second saddle means pivotally connected to the lower end of said drive unit; and connecting means connecting the first and second saddle means of said drive unit to a first of said lever arms and to a second of said lower arms, said connecting means comprising a first pair of spaced and parallel cross-bars extending transversely between a first pair of arms of said linkages on opposite sides of the centers thereof, a second pair of spaced and parallel cross-bars extending transversely between a second pair of arms of said linkages on opposite sides of the centers thereof, a first pair of spaced and parallel longitudinal brackets extending between the cross-bars of the first pair of cross-bars, a second pair of spaced and parallel longitudinal brackets extending between the cross-bars of the second pair of cross-bars, said first saddle means comprising a plurality of first linkage arms, each of said linkage arms having one end pivotally coupled to one end of said drive unit and each of said first linkage arms having their other ends pivotally coupled to the longitudinal brackets of the first pair of longitudinal brackets, said second saddle means comprising a plurality of second linkage arms, each of said second linkage arms having one end pivotally coupled to another end of said drive unit, and each of said second linkage arms having their other ends pivotally coupled to the longitudinal brackets of said second pair of longitudinal brackets so that said first pair of cross-bars is pivotally secured to the first saddle means and operatively connecting one end of said drive unit to said first pair of lever arms at a point intermediate the ends thereof, and said second pair of cross-bars is pivotally secured to the second saddle means and operatively connecting the other end of said drive unit to said second pair of lever arms at a point intermediate the ends thereof, the first and second pairs of cross-bars being essentially vertically movable in opposite directions as the lift mechanism raises and lowers the upper platform.

21. The load lifting scissors lift assembly defined in claim 20 in which said extensible drive unit comprises an hydraulic cylinder unit having a cylinder and a piston, and wherein the cylinder is connected to the first saddle means and the piston is connected to the second saddle means.

22. The load lifting scissors lift assembly defined in claim 20 in which one end of the arms of said first pair of arms is each pivotally coupled to one end of said second pair of arms.

23. The load lifting scissors lift assembly defined in claim 20 in which said first cross-bars are each connected to a point on each said first arm on said first pair of arms between the center and one end thereof, and in which said second cross-bars are each connected to a point on each said second arm on the second pair of arms between the center and one end thereof.

* * * * *